US012181198B2

(12) United States Patent
Dos Santos, Jr. et al.

(10) Patent No.: US 12,181,198 B2
(45) Date of Patent: Dec. 31, 2024

(54) REFRIGERATOR APPLIANCE AND LATCH FOR AN ICE BIN ACCESS PANEL OF THE REFRIGERATOR APPLIANCE

(71) Applicant: WHIRLPOOL CORPORATION, Benton Harbor, MI (US)

(72) Inventors: Ignacio João Dos Santos, Jr., Joinville (BR); Marcel Bögger Lessa, Joinville (BR); Luiz H T Longo, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 364 days.

(21) Appl. No.: 17/746,174

(22) Filed: May 17, 2022

(65) Prior Publication Data

US 2023/0375247 A1 Nov. 23, 2023

(51) Int. Cl.
*F25C 5/182* (2018.01)
*F25D 23/02* (2006.01)

(52) U.S. Cl.
CPC ..... *F25C 5/182* (2013.01); *F25D 23/028* (2013.01)

(58) Field of Classification Search
CPC .. F25C 5/182; F25C 5/22; F23D 23/04; F23D 23/087; F23D 2323/023; Y10S 292/71; E05B 65/0042
See application file for complete search history.

(56) References Cited

U.S. PATENT DOCUMENTS

| | | | | |
|---|---|---|---|---|
| 4,261,605 | A * | 4/1981 | Hock | E05C 3/14 292/228 |
| 8,627,678 | B2 | 1/2014 | Choi | |
| 2011/0146323 | A1* | 6/2011 | Choi | F25D 23/04 62/340 |
| 2020/0278142 | A1 | 9/2020 | Becker et al. | |
| 2020/0284500 | A1* | 9/2020 | Aranda | F25D 11/02 |

FOREIGN PATENT DOCUMENTS

| | | | |
|---|---|---|---|
| EP | 2370764 | B1 | 10/2019 |
| KR | 100717434 | B1 | 5/2007 |
| WO | 2021236072 | A1 | 11/2021 |

* cited by examiner

*Primary Examiner* — Elizabeth J Martin
(74) *Attorney, Agent, or Firm* — Brooks Kushman P.C.

(57) ABSTRACT

A refrigerator appliance includes a door, an access panel, and a latch. The door defines an ice storage compartment. The access panel is configured to transition between open and closed positions. The access panel is configured to cover the ice storage compartment in the closed position. The access panel is configured to provide access to the ice storage compartment in the open position. The access panel has a protrusion extending outward therefrom. The latch is secured to the door. The latch defines a notch configured receive the protrusion to secure the access panel in the closed position. The latch has a ramped surface configured to guide the protrusion toward the notch during the engagement between the latch and the access panel.

20 Claims, 6 Drawing Sheets

REFRIGERATOR APPLIANCE AND LATCH FOR AN ICE BIN ACCESS PANEL OF THE REFRIGERATOR APPLIANCE

TECHNICAL FIELD

The present disclosure relates to an appliance such as a refrigerator.

BACKGROUND

Refrigerator appliances may include systems that require a water supply. Such systems may be configured to produce ice cubes or to deliver water to a user via a dispensing device that may be located on a door of the refrigerator.

SUMMARY

A refrigerator appliance includes a cabinet, a door, an access panel, a gasket, and a latch. The cabinet defines an internal storage chamber. The door is secured to the cabinet and has a frame defining a receptacle along an interior of the door. The receptacle is configured to receive an ice container. The access panel is rotatably secured to the door along a first side of the frame. The access panel is configured to pivot relative to the door between open and closed positions. The access panel is configured cover the receptacle in a closed position. The access panel is configured to provide access to the receptacle in the open position. The access panel has a first surface facing away from the receptacle. The access panel has a second surface facing toward from the receptacle. The access panel has at least one protrusion extending outward from the first surface. The gasket protrudes from the second surface and is configured to engage the frame when the access panel is in the closed position to create a seal between the receptacle and an exterior space around the receptacle. The latch is rotatably secured to a second side of the frame opposite of the first side of the frame. The latch defines a notch configured receive the at least one protrusion to secure the access panel in the closed position and force the gasket into engagement with the frame to create the seal. The latch has a ramped surface extending to the notch. The ramped surface is configured to guide the at least one protrusion toward the notch during an engagement between the latch and the access panel.

A refrigerator appliance includes a door, a panel, and a latch. The door defines a receptacle configured to receive an ice container. The panel has first and second opposing edges. The panel is rotatably secured to the door along the first edge. The panel is configured to pivot relative to the door between open and closed positions. The panel is configured cover the receptacle in the closed position. The panel is configured to provide access to the receptacle in the open position. The panel has a protrusion extending outward from an outer surface proximate to the second edge. The latch is rotatably secured to the door. The latch defines a notch configured receive the protrusion to secure the panel in the closed position. The latch has a ramped surface configured to guide the protrusion toward the notch during the engagement between the latch and the panel.

A refrigerator appliance includes a door, an access panel, and a latch. The door defines an ice storage compartment. The access panel is configured to transition between open and closed positions. The access panel is configured to cover the ice storage compartment in the closed position. The access panel is configured to provide access to the ice storage compartment in the open position. The access panel has a protrusion extending outward therefrom. The latch is secured to the door. The latch defines a notch configured receive the protrusion to secure the access panel in the closed position. The latch has a ramped surface configured to guide the protrusion toward the notch during the engagement between the latch and the access panel.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
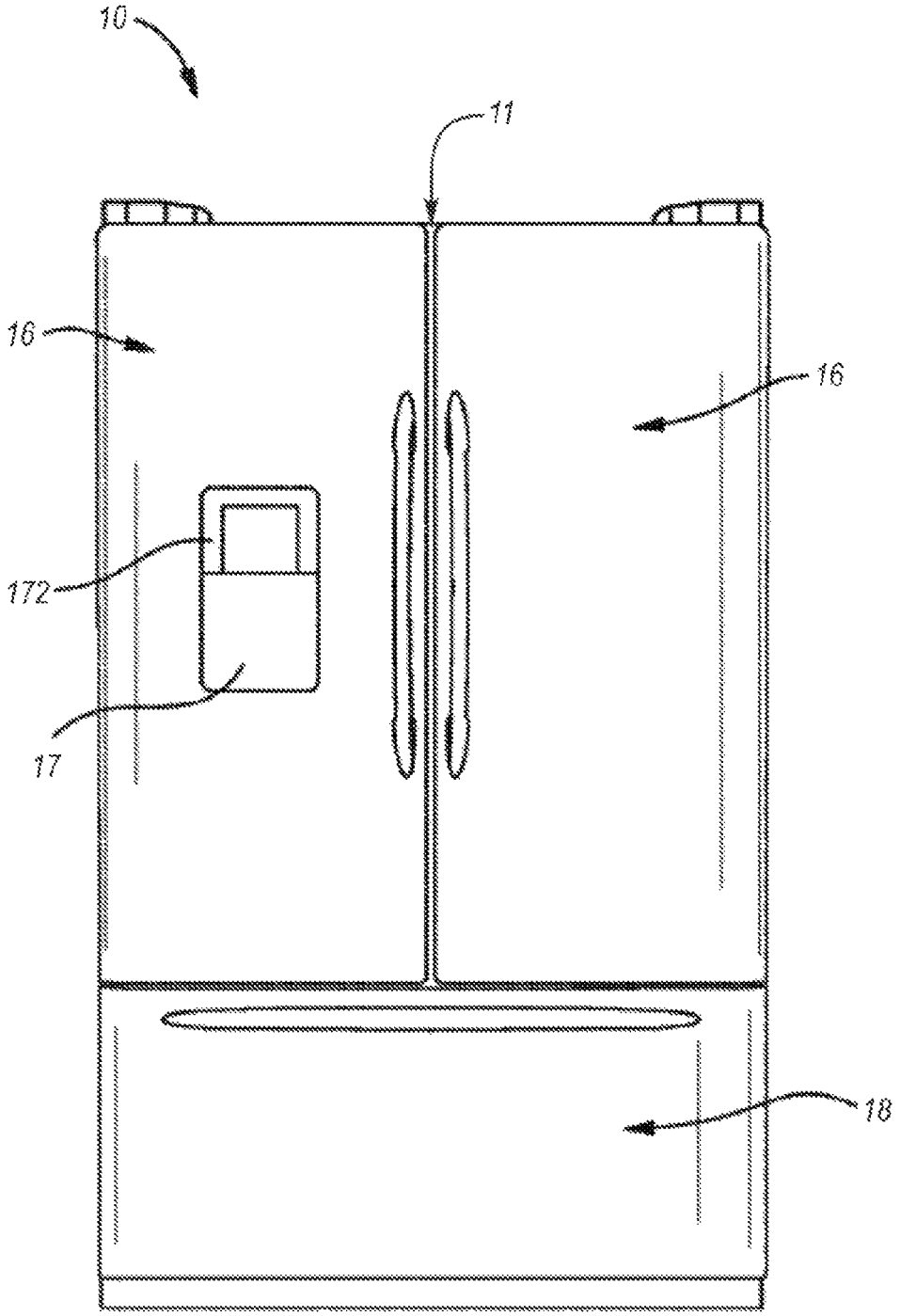
FIG. 1 is an elevated front view of a French-Door Bottom Mount type refrigerator appliance.

Referring to FIG. 1, reference numeral 10 generally designates a refrigerator with an automatic ice maker 20. As described below, an automatic ice maker is an ice maker either as a stand-alone appliance, or within another appliance such as a refrigerator, wherein the ice making process is typically induced, carried out, stopped, and the ice is harvested with substantially no user input.

Figure 2A:
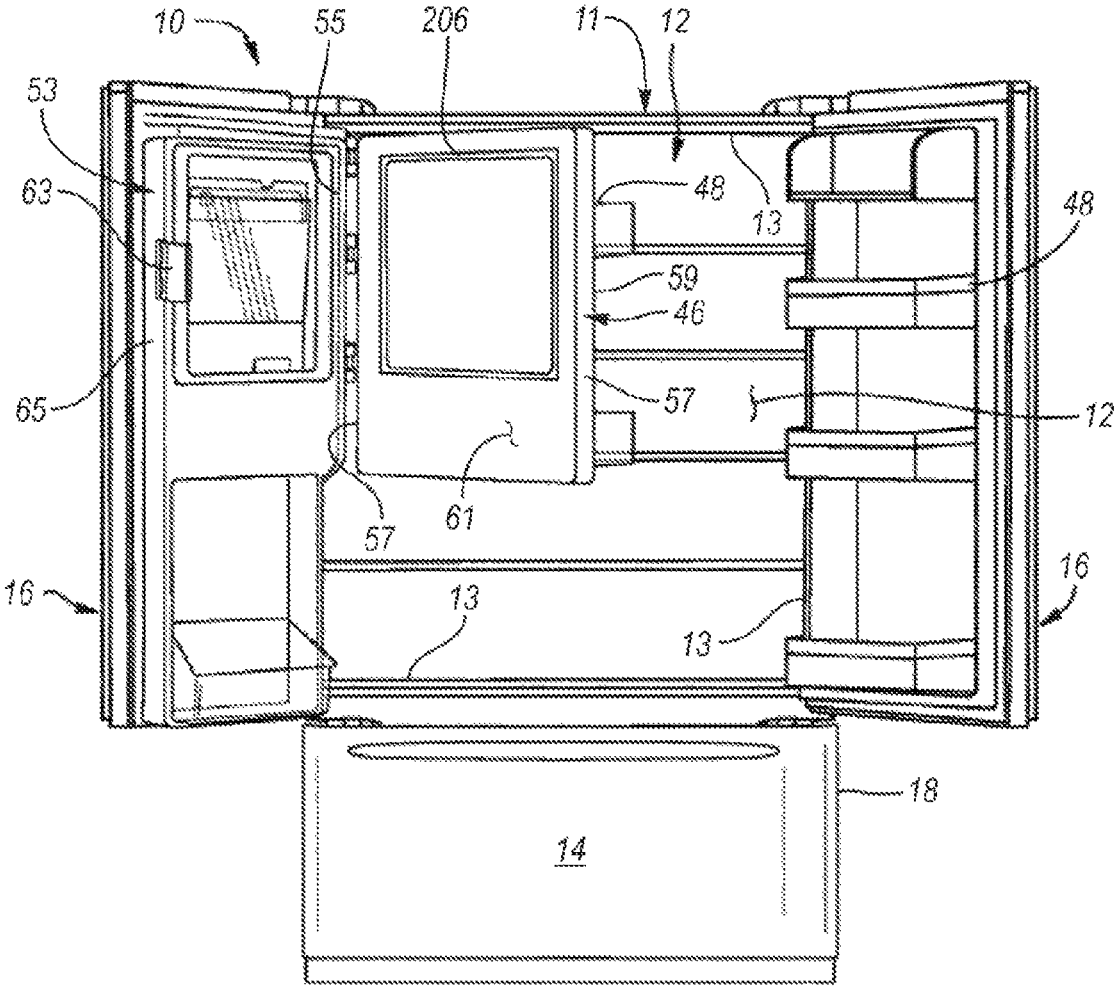
FIG. 2A is an elevated front view of a French-Door Bottom Mount type refrigerator with the refrigerator compartment doors open.
Figure 2B:
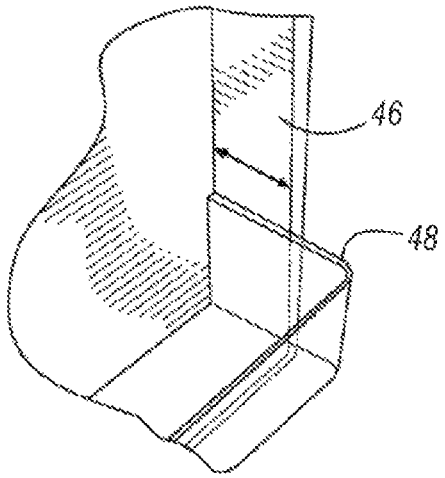
FIG. 2B is a perspective view of an aspect of an access door for the ice maker.

FIG. 1 generally shows a refrigerator 10 of the French-Door Bottom Mount type, but it is understood that this disclosure could apply to any type of refrigerator, such as a side-by-side, two-door bottom mount, or a top-mount type. As shown in FIGS. 1-2B, the refrigerator 10 may have a housing or cabinet 11 that defines a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 (or more specifically the cabinet 11) includes walls 13 that define the fresh food compartment 12 and the freezer compartment 14. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may more specifically be rotatably secured to the cabinet 11 via hinges.

Figure 3:
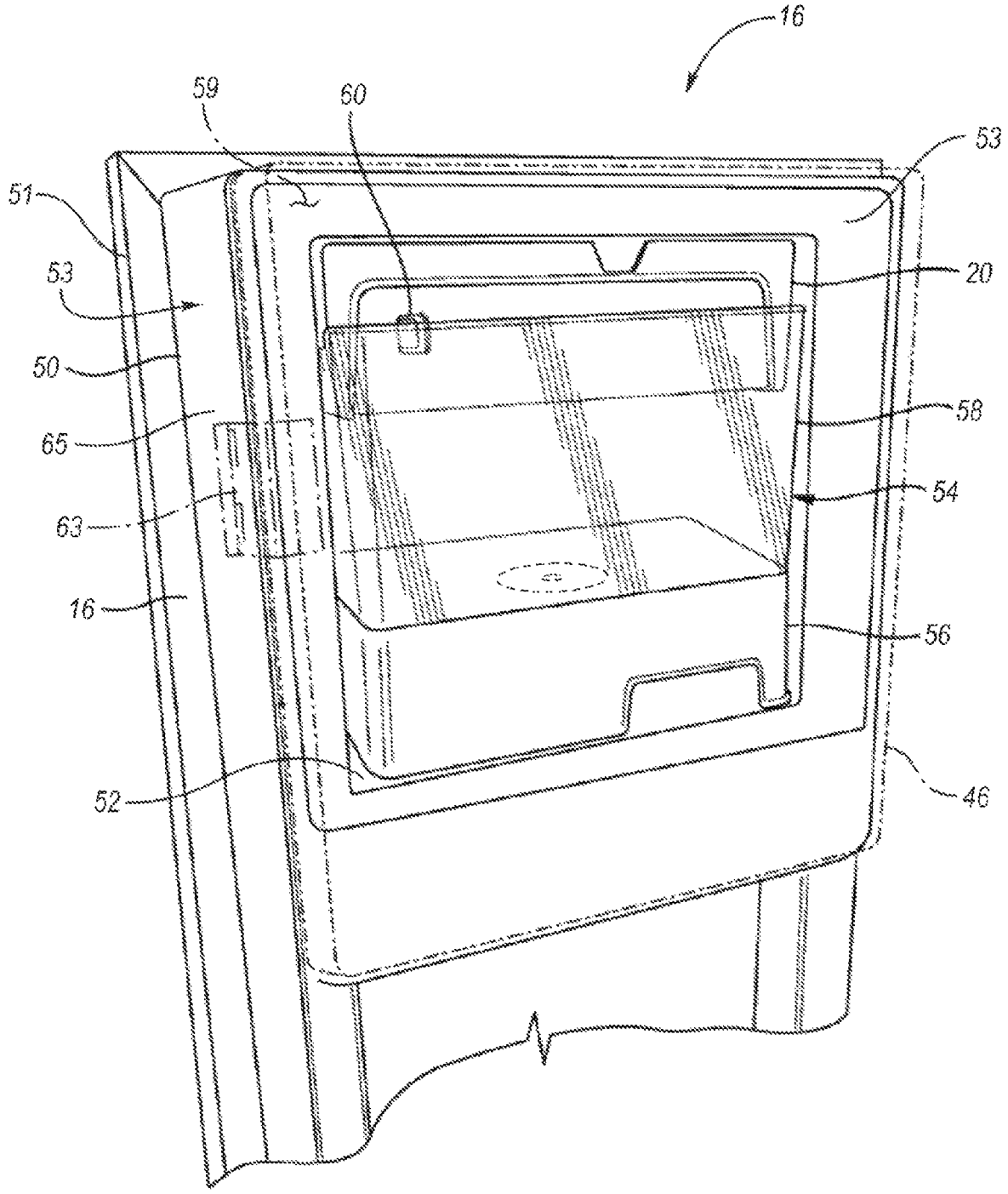
FIG. 3 is a perspective view of the interior of one door of the refrigerator compartment with the ice maker and ice container installed.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F. As shown in FIGS. 2A-3, an ice maker 20 may be located on a door 16 to the refrigerated fresh food compartment 12. The ice maker 20 may be defined as an assembly of a bracket, a motor, an ice tray, a bail arm connected to the motor 24, at least one wire harness and at least one thermistor. An ice maker, such as ice maker 20, is disclosed in U.S. patent application Ser. No. 16/872,690 filed on May 12, 2020, which is incorporated by reference herein in its entirety. The door 16 may include ice maker 20 and ice bin access door 46 rotatably or hingedly connected to one of the doors 16 for the refrigerator 10 along the side proximate the hinge for the door 16 of the refrigerator 10 carrying the ice maker 20, i.e. the vertical edge closest to the cabinet. The hinge may be a single or multiple hinge(s) and may be spaced along the entire edge, substantially the entire edge, or more frequently two hinges may be used with one close to the top edge of the access door 46 and one close to the bottom edge of the access door 46.

Significantly, due at least in part to the access door 46 and the design and size of the ice maker 20, the access door 46 has a peripheral edge liner that extends outward from the surface of the access door 46 and defines a dike wall. The dike walls extend from at least the two vertical sides, more typically all four sides and define a door bin receiving volume along the surface of the access door 46. The access door 46 is selectively operable between an open position, in which the ice maker 20 and the ice storage container or bin 54 are accessible, and a closed position, in which the ice maker 20 and the ice storage bin 54 are not accessible. The access door 46 may also include door bins 48 that are able to hold smaller food items. The door bins 48 may also be located on or removably mounted to the access door 46 and at least partially spaced within the door bin receiving volume of the access door 46. While not typically the case, the ice maker 20 may also be located exterior the fresh food compartment 12, such as on top of the refrigerator cabinet, in a mullion between the fresh food compartment 12 and the freezer compartment 14, in a mullion between two fresh food compartments 12, or anywhere else an automatic, motor driven ice maker 20 may be located.

The refrigerator 10 may also have a duct or duct system (not shown) with an inlet in the freezer compartment 14 and an outlet in the fresh food compartment 12. The duct may be situated such that the length of the duct necessary to direct air from the freezer compartment 14 to the fresh food compartment 12 is minimized, reducing the amount of heat gained in the travel between the inlet and the outlet. The duct outlet located in fresh food compartment 12 may be positioned at a location near the ice maker 20. The refrigerator 10 may also have one or more fans, but typically has a single fan (not shown) located in the freezer compartment 14 to force air from the freezer compartment 14 to the fresh food compartment 12. The colder air from the freezer compartment 14 is needed in the ice maker 20 because air below the freezing point of water is needed to freeze the water that enters the ice maker 20 to freeze into ice cubes. In the embodiment shown, the ice maker 20 is located in the fresh food compartment 12, which typically holds air above the freezing point of water.

In various embodiments, where the ice maker 20 is located in a compartment or location other than in the freezer compartment 12, a fan is needed to force the air to the ice maker 20. In other embodiments, the fan or fans may be located either in the freezer compartment 14, the fresh food compartment 12, or in another location where the fan is able force air through the duct. The ice maker 20 is often positioned within a door of the refrigerator 10 to allow for delivery of ice through the door 16 in a dispensing area 17 on the exterior of the refrigerator 10, typically at a location on the exterior below the level of the ice storage bin 54 to allow gravity to force the ice down an ice dispensing chute into the refrigerator door 16. The chute extends from the bin to the dispensing area 17 and ice is typically pushed into the chute using an electrical power-driven auger. Ice is dispensed from the ice storage bin 54 to the user of the refrigerator 10.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

FIG. 3 shows a closer view of a door 16 with the access door 46 in hidden lines to show the ice maker 20. The door 16 may have an inner liner 50 that is secured to an outer panel 51. The door liner 50 is disposed on an internal side of the outer panel 51 and defines an ice maker receiving space 52 in which the ice maker 20 and an ice storage bin 54 of the ice maker assembly are disposed. The ice maker receiving space 52 may be referred to a cavity or receptacle that is defined by the inner liner 50 and is configured to receive the ice storage bin 54. More specifically, the inner liner 50 of the door 16 may have frame 53 that defines the ice maker receiving space 52. The ice storage bin 54 may be removably positioned within the ice maker receiving space 52 (i.e., the ice storage bin 54 may be inserted into or removed from the ice maker receiving space 52). The ice maker 20 may be located at an upper portion of the ice maker receiving space 52. The ice bin 54 may be located below the ice maker 20 such that as ice is harvested, the ice maker 20 uses gravity to transfer the ice from the ice maker 20 to the ice storage bin 54. The ice storage bin 54 may comprise an ice bin base 56 and one or more ice bin walls 58 that extends upwardly from the perimeter of the ice bin base 56.

The access door 46 may also be referred to as the access panel. The access door 46 is rotatably secured to the door 16 along a first side 55 of the frame 53. More specifically, the access door 46 has first and second opposing edges 57. A first of the opposing edges 57 is rotatably secured to the door 16 along the first side 55 of the frame 53. The access door 46 is configured to pivot relative to the door 16 between an open position (e.g., FIG. 2A) and a closed position (e.g., FIG. 3). The access door 46 is configured cover the ice maker receiving space 52 in the closed position. The access door 46 is configured to provide access to the ice maker receiving space 52 in the open position. The ice storage bin 54 is removable from the ice maker receiving space 52 while the access door 46 is in the open position and is secured within the ice maker receiving space 52 while the access door 46 is in the closed position. The access door 46 has a first surface 59 facing away from the ice maker receiving space 52 and a second surface 61 facing toward from the ice maker receiving space 52. A latch 63 is secured to the door 16. More specifically, the latch 63 may be rotatably secured to a second side 65 of the frame 53 opposite of the first side 55 of the frame 53. The latch 63 is configured to lock the access door 46 in the closed position. The latch 63 is also shown in hidden lines in FIG. 3 to show the ice maker 20.

The ice maker 20 may include an on/off switch 60. The on/off switch 60 may be located on the ice maker 20 in a location that is accessible to a user without removing the ice maker 20 from the door 16 or the refrigerator 10. The ice bin wall 58 may be configured such that when the ice storage bin 54 is placed in the door 16, the on/off switch 60 is inaccessible to the user, and when the ice storage bin 54 is removed from the door 16, the on/off switch 60 is accessible to a user. The ice storage bin wall 58 may be made of a clear plastic material such as a copolyester so that a user can see the on/off switch 60 even while inaccessible when the ice bin 54 is in place. However, the front portion of the ice bin wall 58 typically extends to cover the on/off switch 60 when in the installed position to prevent inadvertent actuation of the on/off switch 60. The front portion of the ice bin wall 58 also typically extends upward to form a lip that extends around at least a portion of the ice maker 20 to further retain ice.

The ice maker 20, the door 16 (or more specifically, the portions of the door 16 that define the ice maker receiving space 52), and the ice storage bin 54 may collectively be referred to as an ice maker assembly. The door 16 (or more specifically, the portions of the door 16 that define the ice maker receiving space 52) and the ice storage bin 54 may collectively be referred to as an ice bin assembly. Additional details of the physical attributes that may comprise the ice maker assembly and the ice bin assembly are disclosed in U.S. patent application Ser. No. 16/872,690 filed on May 12, 2020, which is incorporated by reference herein in its entirety.

Figure 4:
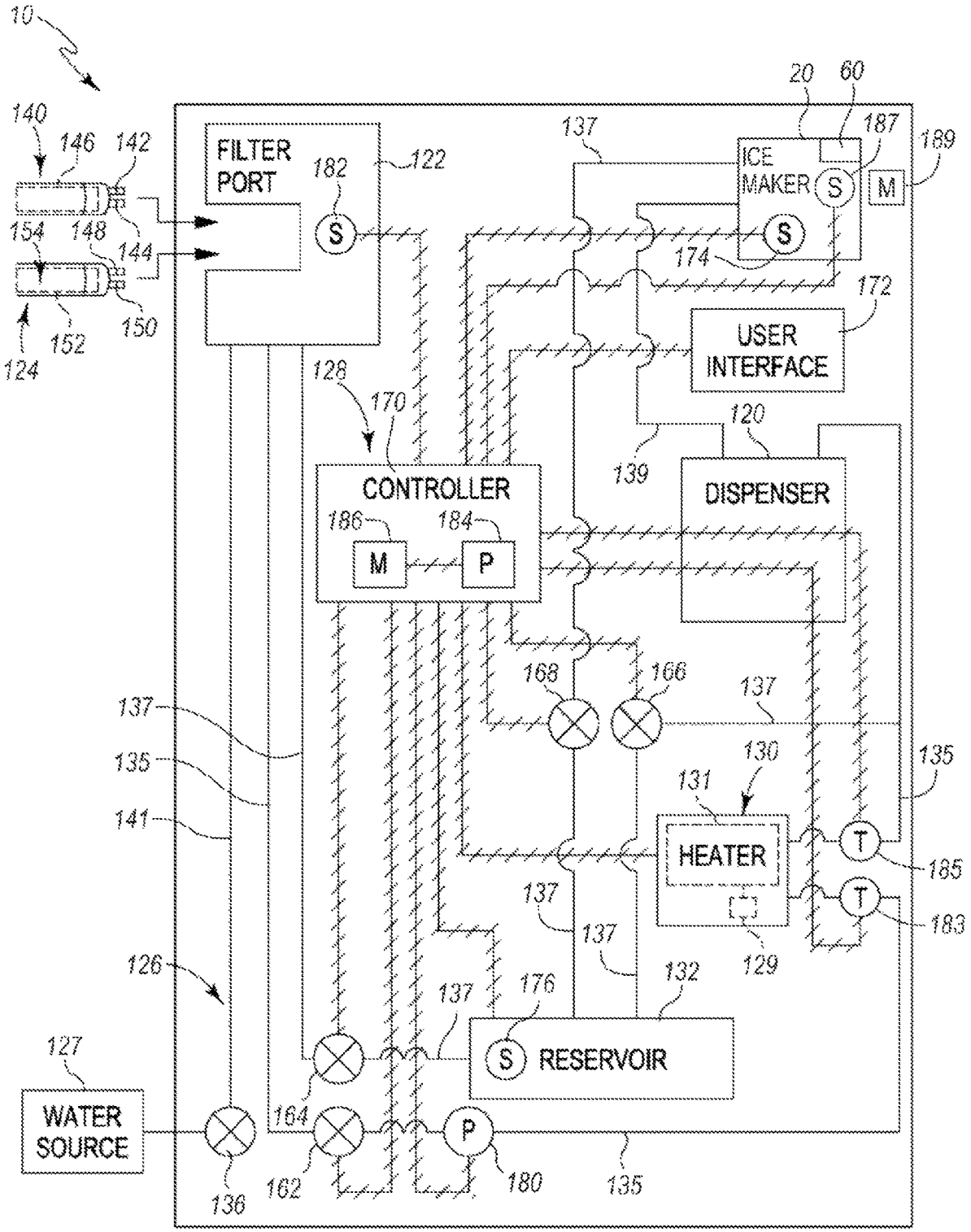
FIG. 4 is a diagrammatic view of the refrigerator appliance.
Figure 5:
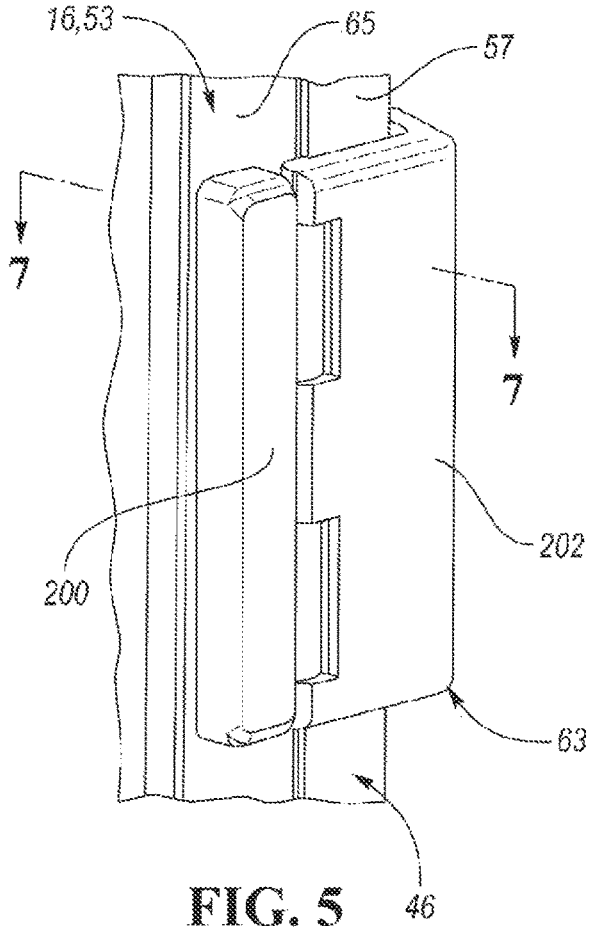
FIG. 5 is a side isometric view of a latch for an ice bin access door.
Figure 6:
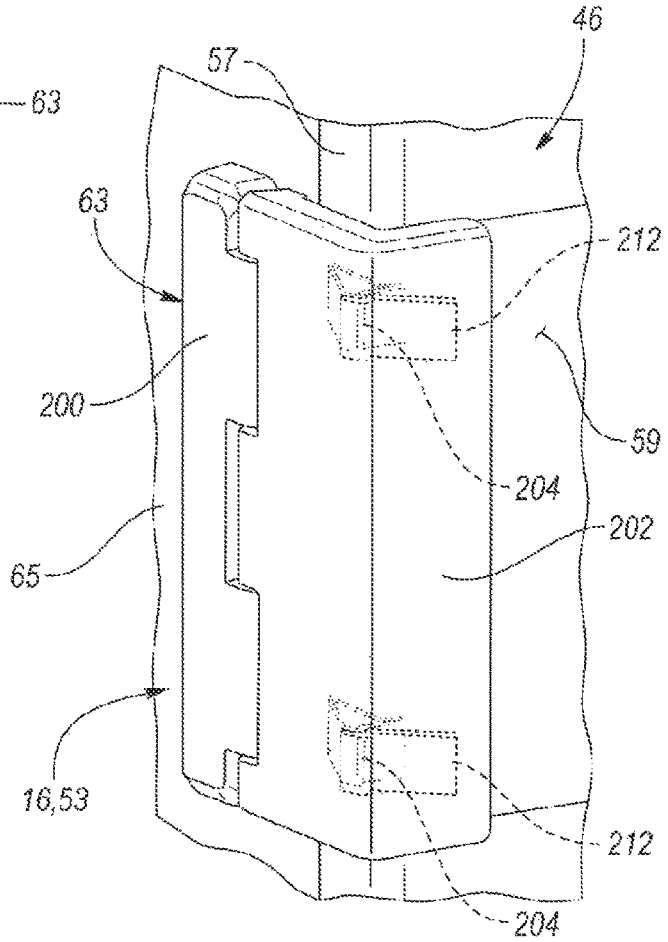
FIG. 6 is a front isometric view of the latch for the ice bin access door.

Referring now to FIG. 4, the refrigerator 10 includes a water system 126 and a control system 128 for controlling the water system 126. The water system 126 directs water from a water source 127 to the dispenser 120 which may be located in dispensing area 17. The control system 128 may be operable to control the various components of the water system 126 so that the dispenser 120 dispenses cold water, hot water, or ice. The control system 128 is also operable to control the water system 126 during a pre-programmed descaling cycle or other pre-programmed cycle.

The water system 126 includes a number of components for conditioning water to be discharged through the dispenser 120. In particular, the water system may have a heating assembly 130, a cold water reservoir 132, and include icemaker 20. The heating assembly 130 includes a flow-through heating element 131 and a thermal fuse 129 configured to cut power to the flow-through heating element 131 when the flow-through heating element 131 reaches a predetermined temperature. The heating assembly 130 may be positioned between the water filter port 122 and the dispenser 120 along a hot water line 135. The cold water reservoir 132 accumulates and cools water in the refrigerator 10 prior to the water being discharged through the dispenser 120 or supplied to the ice maker 20. The cold water reservoir 132 is positioned between the water filter port 122 and the dispenser 120 along a cold water line 137. The icemaker 20 receives cold water from the cold water reservoir 132 and generates ice that is discharged through the dispenser 120 via an ice line 139.

One exemplary flow-through heating element 131 is a Ferro Flow Through Heater (FTH). The flow-through heating element 131 may positioned in the refrigerator door 16 below the dispenser 120 and outside a refrigerator insulation layer. The flow-through heating element 131 is illustratively oriented in a flat orientation so that water flows in a substantially horizontal direction through the flow-through heating element 131. In some embodiments, the flow-through heating element 131 may be a thermoblock element, a microwave element, or another suitable type of heating element. Additionally, the heating element may be positioned in another location in the door 16 or the refrigerator 10 and may be placed in a number of orientations relative thereto. In alternative embodiments of the present disclosure, the flow-through heating element 131 may be replaced or augmented by a batch heating system including a heating element and a hot water reservoir.

All the water (liquid or ice) dispensed by the refrigerator 10 may pass through the water filter port 122. The water system 126 may include a main valve 136 coupled to the water source 127 and the water filter port 122 may be coupled to the main valve 136 via a water inlet line 141. The hot water line 135 and the cold water line 137 may extend from the water filter port 122 directing water through the rest of the water system 126. The main valve 136 may be manually opened or closed to selectively allow water from the water source 127 to enter the water system 126 of the refrigerator 10.

The water filter port 122 may be configured to receive a water filter cartridge 140 or the descaling cartridge 124. The water filter cartridge 140 is illustratively consumable and discarded after use. The water filter cartridge 140 includes an inlet 142, an outlet 144, and a filter media 146 as is known in the art. In other embodiments, the water filter cartridge 140, or portions thereof, may be reusable. The descaling cartridge 124 is illustratively consumable and is charged to supply enough descaling agent 154 for one descaling cycle. In other embodiments, the descaling cartridge 124 may be refillable and/or reusable.

The descaling cartridge 124 may include an inlet 148, an outlet 150, and a descaling packet 152 containing descaling agent 154. The inlet 148 may be open to the water lines of the refrigerator 10. The descaling packet 152 may be coupled to the outlet 150 and may be squeezed by water flowing into the descaling cartridge 124 so that the descaling agent 154 is dispensed through the outlet 150 into the water lines. Water ceases to flow into the descaling cartridge 124 when the descaling cartridge 124 is full of water and the descaling packet 152 is emptied. The descaling agent 154 may then be advanced through the water system 126 and reacts with the scale built up in the water system 126 so that the scale can be flushed out of the water system 126 when the reacted descaling agent 154 is discharged through the dispenser 120. In the illustrative embodiment, the descaling agent 154 is a solution with about an 8 percent concentration of acetic acid. In other embodiments, other organic acids including but not limited to sulfonic acids or carboxylic acids, in particular, lactic acid, acetic acid, formic acid, oxalic acid, uric acid solutions may be used alone or mixtures thereof. It is also possible to use inorganic acids such as phosphoric acid, hydrochloric acid or sulfamic acid solutions. Mixtures of various inorganic and organic acids could also conceivably be used as descaling agents in accordance with embodiments of the present invention.

In other embodiments, the inlet 148 and the outlet 150 may both be open to the water lines of the refrigerator 10. In such embodiments, the descaling packet 152 may be open inside the descaling cartridge 124 or opened when water enters the descaling cartridge 124 so that water flowing through the descaling cartridge is mixed with descaling agent. The water mixing with the descaling agent 154 dilutes and carries the descaling agent through the water lines of the refrigerator 10. In some such embodiments, the descaling agent 154 may be a liquid descaling agent or a solid agent.

The water system 126 further includes a number of electronically controlled valves that can be operated to supply hot or cold water to the dispenser 120 or to supply cold water to the icemaker 20. Specifically, the water system may include a hot water valve 162, a cold water valve 164, a cold water dispenser valve 166, and an icemaker valve 168. The hot water valve 162 may be coupled between the water filter port 122 and the dispenser 120 along the hot water line 135. The cold water valve 164 may be coupled between the water filter port 122 and the dispenser 120 along the cold water line 137. The cold water dispenser valve 166 may be coupled between the cold water reservoir 132 and the dispenser 120 along the cold water line 137. The icemaker valve 168 may be coupled between the cold water reservoir 132 and the icemaker 20 along the cold water line 137.

In operation, the hot water valve 162 can be opened to advance water from the water source 127 through the heating assembly 130 to the dispenser 120. The cold water valve 164 can be opened to advance water from the water source 127 to the cold water reservoir 132. The cold water dispenser valve 166 can be opened to advance cold water from the cold water reservoir 132 to the dispenser 120. The icemaker valve 168 can be opened to advance water from the cold water reservoir 132 to the icemaker 20. Otherwise, each of the valves 162, 164, 166, 168 may be biased closed to prevent water from being advanced through the water system 126.

The control system 128 of the refrigerator 10 illustratively includes a controller 170, a user interface 172, and a number of sensors 174, 176, 180, 182, 183, 185, 187. The controller 170 is configured to operate the components of the water system 126 in response to inputs from the user interface 172 and the sensors 174, 176, 180, 182, 183, 185, 187. The user interface 172 is configured to display information and to receive user inputs. The sensors 174, 176, 180, 182, 183, 185, 187 detect information and communicate information to the controller 170.

The controller 170 includes a number of electronic components commonly associated with electronic units which are utilized in the control of electromechanical systems. For example, the controller 170 may include, amongst other components customarily included in such devices, a processor such as a microprocessor 184 and a memory device 186 such as a programmable read-only memory device ("PROM") including erasable PROM's (EPROM's or EEPROM's). The memory device 186 is provided to store, amongst other things, instructions in the form of, for example, a software routine (or routines) which, when executed by the processor, allows the controller 170 to control operation of the water system 126 and other systems included in the refrigerator 10.

The user interface 172 is illustratively coupled to the controller 170 for two way communication via a signal line as shown in FIG. 4. User interface 172 may include control buttons, paddles, and indicator lights. The buttons may be pressed to receive user inputs requesting that water dispensed be cold or hot, that ice dispensed be cubed or crushed, or that pre-programmed cycles (such as the descaling cycle) be performed by the refrigerator 10. The paddles may be pressed so that the controller 170 receives inputs requesting that water or ice be discharged by the dispenser 120. The indicator lights may be used to indicate the temperature of water to be dispensed, the type of ice to be dispensed, the status of the water filter cartridge 140, the need for a descaling cycle, the availability of one or more functions of the refrigerator 10, or other information. In some embodiments, the user interface 172 may include a graphic display, a touch screen, or other interface operable to display information and to receive user inputs.

The controller 170 is electrically coupled to each of the sensors 174, 176, 180, 182, 183, 185, 187 to receive inputs from each of the sensors 174, 176, 180, 182, 183, 185, 187 as shown in FIG. 4. In particular, the sensors 174, 176, 180, 182, 183, 185, 187 may include an ice level sensor 174, a reservoir sensor 176, temperature sensors 183, 185, a pressure sensor 180, a filter port sensor 182, and a sensor 187 to detect the presence of the ice storage bin 54 in the ice maker receiving space 52. The ice level sensor 174 is coupled to the controller 170 via a signal line and is configured to detect if the ice storage bin 54 is full. The reservoir sensor 176 is coupled to the controller 170 via a signal line and is configured to detect if the cold water reservoir 132 is full or the water level in the cold water reservoir 132. In the illustrative embodiment, water discharged through the dispenser 120 after being heated in the heating assembly 130 may be between 175-185° F., and may be typically be about 180° F. In other embodiments, water discharged through the dispenser 120 after being heated in the heating assembly 130 may be hotter or cooler. The pressure sensor 180 is coupled to the controller 170 via a signal line and is configured to detect back pressure applied to the heating assembly 130 through the hot water valve 162. In some embodiments, the hot water valve 162 may be configured to regulate the pressure being supplied to the heater assembly 130. The filter port sensor 182 is coupled to the controller 170 via a signal line and is configured to detect the presence of the water filter cartridge 140 or the descaling cartridge 124. The temperature sensors 183, 185 are coupled to the controller 170 via signal lines and are configured to monitor the temperature of water entering and exiting the heating assembly 130. If the temperature difference between the sensors 183, 185 across the heating assembly 130 is determined by the controller 170 to be outside a predetermined range, the controller 170 may disable the heating assembly 130.

Sensor 187 is coupled to the controller 170 via a signal line and is configured to detect the presence or absence of a magnet 189. The presence of the magnet 189 is indicative that the ice storage bin 54 is properly positioned in the ice maker receiving space 52 to receive ice produced by the ice maker 20. The absence of the magnet 189 is indicative that the ice storage bin 54 is not positioned, or is not properly positioned, in the ice maker receiving space 52 to receive ice produced by the ice maker 20. The sensor 187 may communicate the presence or absence of the magnet 189 to the controller 170. The controller 170 may be programmed to, in response to the sensor 187 detecting the presence of the magnet 189, initiate or allow the production of ice via the ice maker 20. The controller 170 may also be programmed to, in response to the sensor 187 detecting the absence of the magnet 189 (e.g., the sensor 187 not detecting the magnet 189), prevent the ice maker 20 from the producing of ice. The sensor 187 may be a reed switch that is configured to close a circuit when the magnetic field of the magnet 189 is detected and to open the circuit when no magnetic field is detected, or vice versa.

Additionally, the controller 170 is electrically coupled to the electrically controlled valves 162, 164, 166, 168 and the heating assembly 130 as shown in FIG. 4. Specifically, the cold water valve 164 is coupled to the controller 170 via a signal line so that the controller 170 can direct the cold water valve 164 to open or close. The hot water valve 162 is coupled to the controller 170 via a signal line so that the controller 170 can direct the hot water valve 162 to open or close. The icemaker valve 168 is coupled to the controller 170 via a signal line so that the controller 170 can direct the icemaker valve 168 to open or close. The cold water dispenser valve 166 is coupled to the controller 170 via a signal line so that the controller 170 can direct the cold water dispense valve 166 to open or close. The heating assembly 130 is coupled to the controller 170 via a signal line so that the controller 170 can direct the heating assembly 130 to activate or deactivate the flow-through heating element 131.

Hence, the control system 128 including the controller 170 may be operated to control operation of the refrigerator 10. In particular, the controller 170 executes a routine including, among other things, a control scheme in which the controller 170 monitors outputs of the sensors 180, 185 in order to inform a user of detected scale build-up and to control the availability of hot water when water system 126 contains built up scale. To do so, the controller 170 communicates with the sensors 180, 185 in order to determine, among other things, if the water system 126, (and more particularly, if the components of the hot water line 135 that conducts water for the hot water function) is likely to contain a predetermined amount of scale build-up as indicated by an elevated temperature or pressure of water flowing through the dispenser 120. In some embodiments, the controller may communicate with both temperature sensors 183, 185 and compare the temperature rise across the heating assembly 130 to determine scale build up. Armed with this data, the controller 170 determines if a descaling cycle is desirable and if continued operation of the hot water function is allowable. Once it is determined if a descaling cycle is found to be desirable, the controller 170 can direct the user interface 172 to display a request for a user to initiate the descaling cycle. If the controller 170 determines that the continued operation of the hot water function is not allowable, the controller 170 can disable the water system 126 from providing hot water to the dispenser 120.

Referring to FIGS. 5-8, the latch 63 and associated components are illustrated in further detail. The latch 63 includes a stationary portion 200 that is secured to the door 16. More specifically, the stationary portion 200 may be secured to the second side 65 of the frame 53. The latch also includes a rotatable portion 202 that is rotatably or hingedly secured to the stationary portion 200. At least one protrusion 204 extends or protrudes outward from the first surface 59 of the access door 46, proximate to a second of the edges 57, and along the second side 65 of the frame 53 when access door 46 is in the closed position. The at least one protrusion 204 may also extend or protrude outward from the second of the edges 57. More specifically, the at least one protrusion 204 may comprise a pair of spaced apart protrusions.

A gasket 206 protrudes from the second surface 61 of the access door 46. The gasket 206 is configured to engage the frame 53 when the access door 46 is in the closed position to create a seal between the ice maker receiving space 52 and an exterior space around the ice maker receiving space 52. The latch 63 (or more specifically the rotatable portion 202 of the latch 63) defines at least one notch 208 configured receive the at least one protrusion 204 to secure the access door 46 in the closed position and force the gasket 206 into engagement with the frame 53 to create the seal. The at least one notch 208 may be round in shape (e.g., the at least one notch 208 may be a partial circle or partial ellipse). The latch 63 (or more specifically the rotatable portion 202 of the latch 63) also includes at least one ramped surface 210 extending to the at least one notch 208. The at least one ramped surface 210 is configured to guide the at least one protrusion 204 toward the at least one notch 208 during an engagement between the latch 63 and the access door 46.

More specifically, the at least one notch 208 and the at least one ramped surface 210 may comprise a pair of notches 208 and a pair of ramped surfaces 210, where one of the notches 208 and one of the ramped surfaces 210 are configured to engage one of the spaced apart protrusions 204 while the other of the notches 208 and the other of the ramped surfaces 210 are configured to engage the other of the spaced apart protrusions 204. Even more specifically, each of a pair of structures 212 that are secured to the latch 63 may include one of the ramped surfaces 210 and define one of the notches 208. The structures 212 may be disposed on an internal side of the latch 63.

The least one protrusion 204 has an opposing ramped surface 214 that is configured to engage the at least one ramped surface 210 of the latch 63 to further facilitate guiding the at least one protrusion 204 toward the at least one notch 208 during the engagement between the latch 63 and the access door 46. The latch 63 has a first member 216, a second member 218, and an elbow 220 securing the first member 216 to the second member 218. More specifically, the first member 216, second member 218, and elbow 220 may be part of the rotatable portion 202 of the latch 63. The at least one notch 208 is defined along an interior side of the elbow 220. The at least one ramped surface 210 extends along an interior side of the first member 216 to the at least one notch 208. The latch 63 is rotatably secured to the door 16 along an end of the second member 218 opposite of where the elbow 220 connects to the second member 218. More specifically, the rotatable portion 202 of the latch 63 may be rotatably secured to the stationary portion 200 of the latch 63 via hinge 222, and the stationary portion may be secured to the second side 65 of the frame 53, the frame 53 being part of the inner liner 50, and the inner liner 50 being part of the door 16.

The first member 216 and the second member 218 may be substantially perpendicular to each other. substantially perpendicular may refer to an incremental angle this between exactly perpendicular and 15° from exactly perpendicular.

Figure 7:
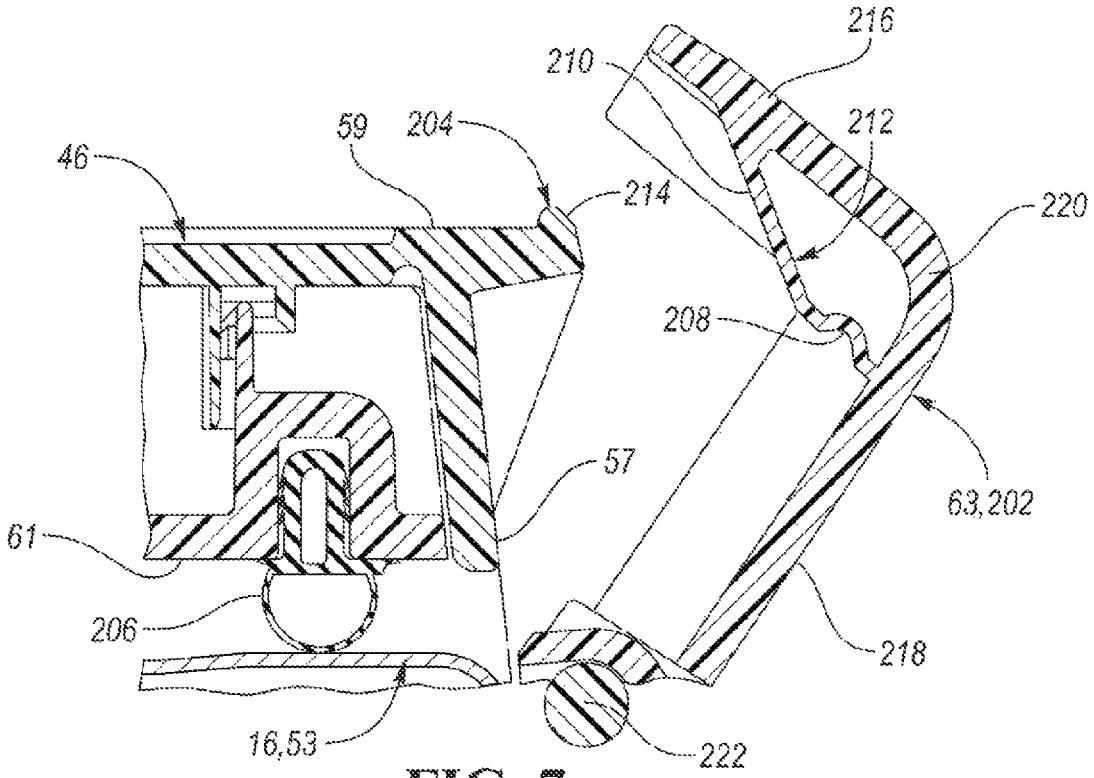
FIG. 7 is a cross-sectional view of the latch taken along line 7-7 in FIG. 5 with the latch disengaged from the ice bin access door.
Figure 8:
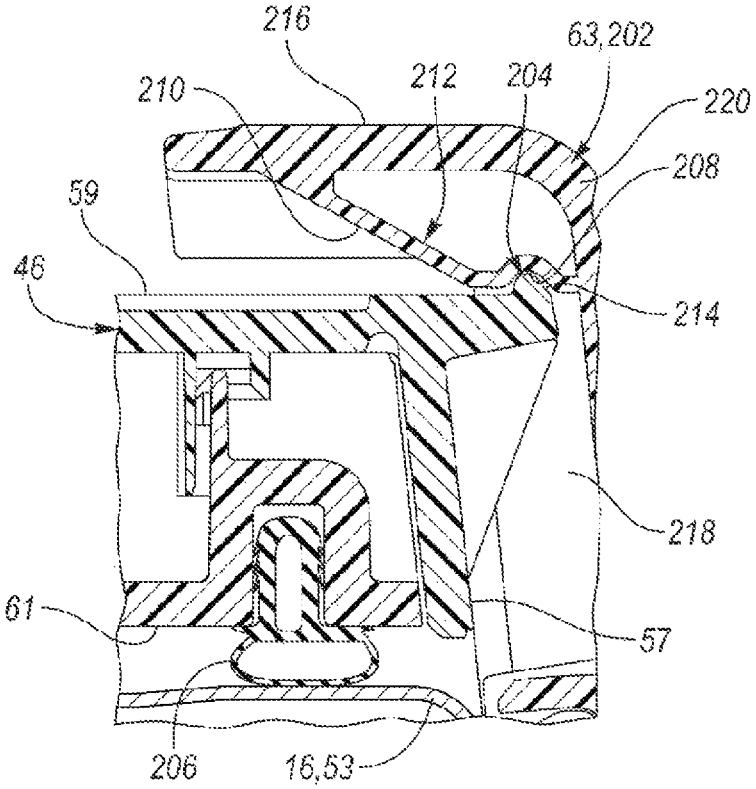
FIG. 8 is a cross-sectional view of the latch taken along line 7-7 in FIG. 5 with the latch engaging the ice bin access door.

In FIG. 7 the access door 46 is closed but the latch 63 is disengaged from the access door 46 such that the access door 46 is unlocked. In FIG. 8 the access door 46 is closed and the latch 63 is engaging the access door 46 such that the access door 46 is locked. The compression of the gasket 206 when the access door 46 is in the closed position and in a locked condition, creates a force between the latch 63 and the access door 46, which forces the at least one protrusion 204 toward the at least one notch 208, which assists in maintaining the locked the condition of the access door 46.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet defining internal storage chamber;

a door (i) secured to the cabinet and (ii) having a frame defining a receptacle along an interior of the door, wherein the receptacle is configured to receive an ice container;

an access panel (i) rotatably secured to the door along a first side of the frame, (ii) configured to pivot relative to the door between open and closed positions, (iii) configured cover the receptacle in a closed position, (iv) configured to provide access to the receptacle in the open position, (v) having a first surface facing away from the receptacle, (vi) having a second surface facing toward from the receptacle, and (vii) having at least one protrusion extending outward from the first surface;

a gasket protruding from the second surface and configured to engage the frame when the access panel is in the closed position to create a seal between the receptacle and an exterior space around the receptacle; and a latch (i) rotatably secured to a second side of the frame opposite of the first side of the frame, (ii) defining a notch configured receive the at least one protrusion to secure the access panel in the closed position and force the gasket into engagement with the frame to create the seal, and (iii) having a ramped surface extending to the notch, wherein the ramped surface is configured to engage and guide the at least one protrusion toward the notch during an engagement between the latch and the access panel.

2. The refrigerator appliance of claim 1, wherein the at least one protrusion has an opposing ramped surface that is configured to engage the ramped surface of the latch to further facilitate guiding the at least one protrusion toward the notch during the engagement between the latch and the access panel.

3. The refrigerator appliance of claim 1, wherein the latch has a first member, a second member, and an elbow securing the first member to the second member.

4. The refrigerator appliance of claim 3, wherein notch is defined along an interior side of the elbow.

5. The refrigerator appliance of claim 4, wherein the ramped surface extends along an interior side of the first member to the notch.

6. The refrigerator appliance of claim 5, wherein the latch is rotatably secured to the second side of the frame along an end of the second member opposite of the elbow.

7. The refrigerator appliance of claim 1, wherein the notch is round in shape.

8. The refrigerator appliance of claim 1, wherein engagement between the ramped surface and the at least one protrusion operates to gradually compress the gasket as the protrusion is guided toward the notch via the ramped surface.

9. A refrigerator appliance comprising:

a door defining a receptacle configured to receive an ice container;

a panel (i) having first and second opposing edges (ii) rotatably secured to the door along the first edge, (iii) configured to pivot relative to the door between open and closed positions, (iv) configured cover the receptacle in the closed position, (v) configured to provide access to the receptacle in the open position, and (vi) having a protrusion extending outward from an outer surface proximate to the second edge; and a latch (i) rotatably secured to the door, (ii) defining a notch configured receive the protrusion to secure the panel in the closed position, and (iii) having a ramped surface configured to engage and guide the protrusion toward the notch during the engagement between the latch and the panel.

10. The refrigerator appliance of claim 9, wherein the protrusion has an opposing ramped surface that is configured to engage the ramped surface of the latch to further facilitate guiding the protrusion toward the notch during an engagement between the latch and the panel.

11. The refrigerator appliance of claim 9, wherein the latch has a first member, a second member, and an elbow securing the first member to the second member.

12. The refrigerator appliance of claim 11, wherein notch is defined along an interior side of the elbow.

13. The refrigerator appliance of claim 12, wherein the ramped surface extends along an interior side of the first member to the notch.

14. The refrigerator appliance of claim 13, wherein the latch is rotatably secured to the door along an end of the second member opposite of the elbow.

15. The refrigerator appliance of claim 9 further comprising a gasket protruding from the panel and configured to engage the door when the panel is in the closed position to create a seal between the receptacle and an exterior space around the receptacle, and wherein engagement between the ramped surface and the protrusion operates to gradually compress the gasket as the protrusion is guided toward the notch via the ramped surface.

16. A refrigerator appliance comprising:

a door defining an ice storage compartment;

an access panel (i) configured to transition between open and closed positions, (ii) configured to cover the ice storage compartment in the closed position, (iii) configured to provide access to the ice storage compartment in the open position, and (iv) having a protrusion extending outward therefrom; and a latch (i) secured to the door, (ii) defining a notch configured receive the protrusion to secure the access panel in the closed position, and (iii) having a ramped surface configured to engage and guide the protrusion toward the notch during the engagement between the latch and the access panel.

17. The refrigerator appliance of claim 16, wherein the at least one protrusion has an opposing ramped surface that is configured to engage the ramped surface of the latch to further facilitate guiding protrusion toward the notch during the engagement between the latch and the access panel.

18. The refrigerator appliance of claim 16, wherein the latch has a first member, a second member, and an elbow securing the first member to the second member, and wherein notch is defined along an interior side of the elbow.

19. The refrigerator appliance of claim 18, wherein (i) the ramped surface extends along an interior side of the first member to the notch and (ii) the latch is rotatably secured to the door along an end of the second member opposite of the elbow.

20. The refrigerator appliance of claim 16 further comprising a gasket protruding from the access panel and configured to engage the door when the access panel is in the closed position to create a seal between the ice storage compartment and an exterior space around the ice storage compartment, and wherein engagement between the ramped surface and the protrusion operates to gradually compress the gasket as the protrusion is guided toward the notch via the ramped surface.

* * * * *